US008281851B2

(12) United States Patent
Spence

(10) Patent No.: US 8,281,851 B2
(45) Date of Patent: Oct. 9, 2012

(54) COIL TUBING CABLE HEAD WITH TOOL RELEASE, FLUID CIRCULATION AND CABLE PROTECTION FEATURES

(76) Inventor: Dean Spence, Sylvan Lake (CA)

( * ) Notice: Subject to any disclaimer, the term of this patent is extended or adjusted under 35 U.S.C. 154(b) by 267 days.

(21) Appl. No.: 12/840,692

(22) Filed: Jul. 21, 2010

(65) Prior Publication Data

US 2012/0018142 A1 Jan. 26, 2012

(51) Int. Cl.
*E21B 19/00* (2006.01)

(52) U.S. Cl. ..... 166/65.1; 166/242.6

(58) Field of Classification Search ..... 166/65.1, 166/242.6, 242.7
See application file for complete search history.

(56) References Cited

U.S. PATENT DOCUMENTS 3,670,566 A * 6/1972 Basham et al. ..... 73/152.59
4,997,041 A 3/1991 Petree
5,303,776 A 4/1994 Ryan
5,392,851 A 2/1995 Arend
6,196,325 B1 3/2001 Connell et al.
2009/0095466 A1 4/2009 Obrejanu

* cited by examiner

*Primary Examiner* — William P Neuder
(74) *Attorney, Agent, or Firm* — Kyle R. Satterthwaite; Ryan W. Dupuis; Ade & Company Inc.

(57) ABSTRACT

A cable head for use with coiled tubing electric line in well operations has upper and lower housings attached by a shearable connection to allow release of the lower housing and any downhole equipment carried thereon. A piston is slidable within the housing by fluid pumped through the coil tooling to release a locking mechanism that otherwise prevents the shearing disconnect of the housings. Flow ports in the housing to allow pumping or circulation of fluid through the cable head are positioned to remain continuously open, regardless of the piston position, to maximize the range of flow rates over which fluid can be circulated. The electric line of coiled tubing is only stripped of its armor past sealed receipt thereof in a cable passage below the flow path of the fluid, thereby avoiding exposure of the conductor to the fluid to minimize the potential for damage or failure.

17 Claims, 7 Drawing Sheets

COIL TUBING CABLE HEAD WITH TOOL RELEASE, FLUID CIRCULATION AND CABLE PROTECTION FEATURES

FIELD OF THE INVENTION

The present invention relates generally to cable heads for coiled tubing used in well operations, and more particular to such a cable head that facilitates hydraulic releasing of a downhole tool carried on the cable head, allows pumping of fluid downhole through the cable head over a wide range of flow rates and protects the cable from the fluid passing through the cable head.

BACKGROUND OF THE INVENTION

In well operations, downhole electrical equipment or tools are often deployed in the wellbore on the end of a length of coiled tubing, for example for logging of the well, use of downhole cameras or well perforation. The prior art has taught a number of cable heads that provide a releasable connection between the coiled tubing and the downhole electronic tool in case the tool should be become stuck in the wellbore and that also receive the end of the coiled tubing electric line where the line's conductor is stripped of its external armor in order to electrically couple with the electrical components of the tool.

The disconnect function allowing release of the tool from the coiled tubing has been achieved at least in part by the use of shear pins interconnecting portions of the cable head housing so that when the tool becomes stuck, attempted retraction of the coiled tubing back toward the surface pulls on the cable head and the stuck tool coupled thereto until the tension in coiled tubing becomes sufficient to overcome the strength of the shear pins, which accordingly break and allow the upper portion of the housing to separate from the lower housing portion and the tool coupled thereto. The coiled tubing is drawn out of the well, leaving the stuck tool and coupled lower housing within the bore, which may later be retrieved with suitable fishing equipment.

U.S. Pat. No. 6,196,325, which is herein incorporated by reference, suggests problems with use of only such a shear pin connection in a separable cable head structure, in that inadvertent shearing and resulting disconnect may occur during perforating operations and that the tensile strength of the tubing needs careful consideration in selecting suitable shear pins to prevent inadvertent failure of the tubing string during pulling thereof in an attempted disconnection from the tool.

The above patent addresses these issues by employing a spring-biased piston than can be driven downward by pumping fluid down the tubing against to move into a position releasing lugs that otherwise lock the housing components together so that shear pins also connecting the housing components are only sheared once the operator has intentionally instigated a release function by pumping fluid downhole to build up a sufficient pressure to move the piston to the unlocking position releasing the lugs. To provide feedback at the surface on the position of the piston, initial movement thereof closes off through-ports in the housing to cease flow of the fluid until continued pumping builds up the pressure far enough to further displace the piston toward the unlocking position. While this closing of the fluid's flow path to cease circulation informs the operator of displacement of the piston, it also limits the flow rates at which the operator can pump down fluids through the tubing for purposes other than triggering the cable head's tool-release function. Also, the conductor of the electric line exits the cable armor near the top of the cable head, leaving it exposed through most of the line's passage through the cable and thus potentially susceptible to damage, wear or failure by exposure to fluid passing through the cable head.

Applicant has developed a unique cable head that not only provides a fluid-induced disconnect function to prevent inadvertent breakage of the shearable mechanical connection between the tubing and the tool, but also allows fluid circulation at flow rates beyond that which initializes the disconnect process, and protects the line conductor from exposure to the fluid.

SUMMARY OF THE INVENTION

According to a first aspect of the invention there is provided a cable head for use with coiled tubing electric line in well operations, said cable head comprising:

a housing comprising:

an upper housing adapted for connection to a length of coiled tubing;

a lower housing adjacent to said upper housing; and a shearable connection for shearably attaching said lower housing to said upper housing, said shearable connection being shearable in response to relative movement between said upper housing and said lower housing such that said upper housing and said lower housing are separated when tension is applied to the coiled tubing;

a locking mechanism disposed between said upper and lower housings for preventing said relative movement and thereby preventing shearing of said shearable connection when said locking mechanism is in a locked condition and allowing shearing of said shearable connection by said relative movement when said locking mechanism is in an unlocked condition;

a piston slidably disposed in said housing, said piston having a running position holding said locking mechanism in said locked position and being movable to a releasing position allowing movement of said locking mechanism to said unlocked position;

flow ports defined in the housing and communicating a flow path therein with an exterior of the housing to enable circulation of fluid through the flow path, said flow ports being and piston being arranged to leave said flow ports open throughout movement of the piston from the running position to the releasing position; and a cable passage defined in the upper and lower housings to receive the coiled tubing electric line, said cable passage extending from proximate a top end of the upper housing and reaching a point below the flow path and the flow ports.

Preferably the cable passage comprises a lower cable passage that communicates with the flow path and extends to the point below the flow path and the flow ports, the lower cable passage containing at least one lower sealing arrangement adapted to form a fluid tight seal around armor of the coiled tubing electric line.

Preferably the lower cable passage opens to the flow path at a bottom end thereof.

Preferably the flow ports are positioned at the bottom end of the flow path.

Preferably the cable passage comprises an upper cable passage that is open to the top end of the upper housing to receive the coil tubing electric line, said upper cable passage containing a cable anchor to secure the coiled tubing electric line to the upper housing.

The upper cable passage preferably contains an upper sealing arrangement adapted to form a fluid tight seal around armor of the coiled tubing electric line.

Preferably the flow path comprises an internal passage extending through the piston, said internal passage also defining a portion of the cable passage.

When the cable head is used in combination with coiled tubing electric line, which has external armor containing an internal conductor, said armor of said coiled tubing electric line preferably extends down to the position past the flow path and the flow ports, where the internal conductor of the coiled tubing electric line exits the armor for connection to electronic downhole equipment.

Preferably the flow ports are positioned below the piston.

Preferably the flow path, between opposite ends thereof, communicates with the exterior of the housing only through the flow ports regardless of the piston's position.

Preferably said lower housing defines a recess therein, said upper housing defines a lug window therein aligned with said recess; and said locking mechanism comprises a lug disposed in said window and extending into said recess when in said locked position and spaced from said recess when in said unlocked position.

Preferably said piston has a recessed saddle thereon and said lug extends into said saddle when in said unlocked position.

According to a second aspect of the invention there is provided a cable head for use in well operations with coiled tubing electric line having external armor containing an internal conductor, said cable head comprising:

a housing comprising:

an upper housing adapted for connection to a length of coiled tubing;

a lower housing adjacent to said upper housing; and a shearable connection for shearably attaching said lower housing to said upper housing, said shearable connection being shearable in response to relative movement between said upper housing and said lower housing such that said upper housing and said lower housing are separated when tension is applied to the coiled tubing;

a locking mechanism disposed between said upper and lower housings for preventing said relative movement and thereby preventing shearing of said shearable connection when said locking mechanism is in a locked condition and allowing shearing of said shearable connection by said relative movement when said locking mechanism is in an unlocked condition;

a piston slidably disposed in said housing, said piston having a running position holding said locking mechanism in said locked position and being movable to a releasing position allowing movement of said locking mechanism to said unlocked position;

flow ports defined in the housing and communicating a flow path therein with an exterior of the housing to enable circulation of fluid through the flow path; and a cable passage defined in the upper and lower housings to receive the coiled tubing electric line, said cable passage extending from proximate a top end of the upper housing and comprising a lower cable passage that communicates with the flow path and extends to a position below the flow path and the flow ports, the lower cable passage containing at least one lower sealing arrangement adapted to form a fluid tight seal around the armor of the coiled tubing electric line.

Preferably the cable passage comprises an upper cable passage that is open to the top end of the upper housing to receive the coil tubing electric line, said upper cable passage containing a cable anchor to secure the coiled tubing electric line to the upper housing.

The upper cable passage preferably contains an upper sealing arrangement adapted to form a fluid tight seal around armor of the coiled tubing electric line.

Preferably the lower cable passage opens to the flow path at a bottom end thereof.

Preferably the flow ports are positioned at the bottom end of the flow path.

Preferably the flow path comprises an internal passage extending through the piston, said internal passage also defining a portion of the cable passage.

When used in combination with the coiled tubing electric line, the armor of said coiled tubing electric line extends down to the position past the flow path and the flow ports, where the internal conductor of the coiled tubing electric line exits the armor for connection to electronic downhole equipment.

BRIEF DESCRIPTION OF THE DRAWINGS

In the accompanying drawings, which illustrate a exemplary embodiments of the present invention.

DETAILED DESCRIPTION

With reference to the drawings, the cable head features an outer housing with an actuating piston 7 slidably disposed therein. The housing features and upper housing and a lower housing, each of which are formed by a number of components.

Figure 3:
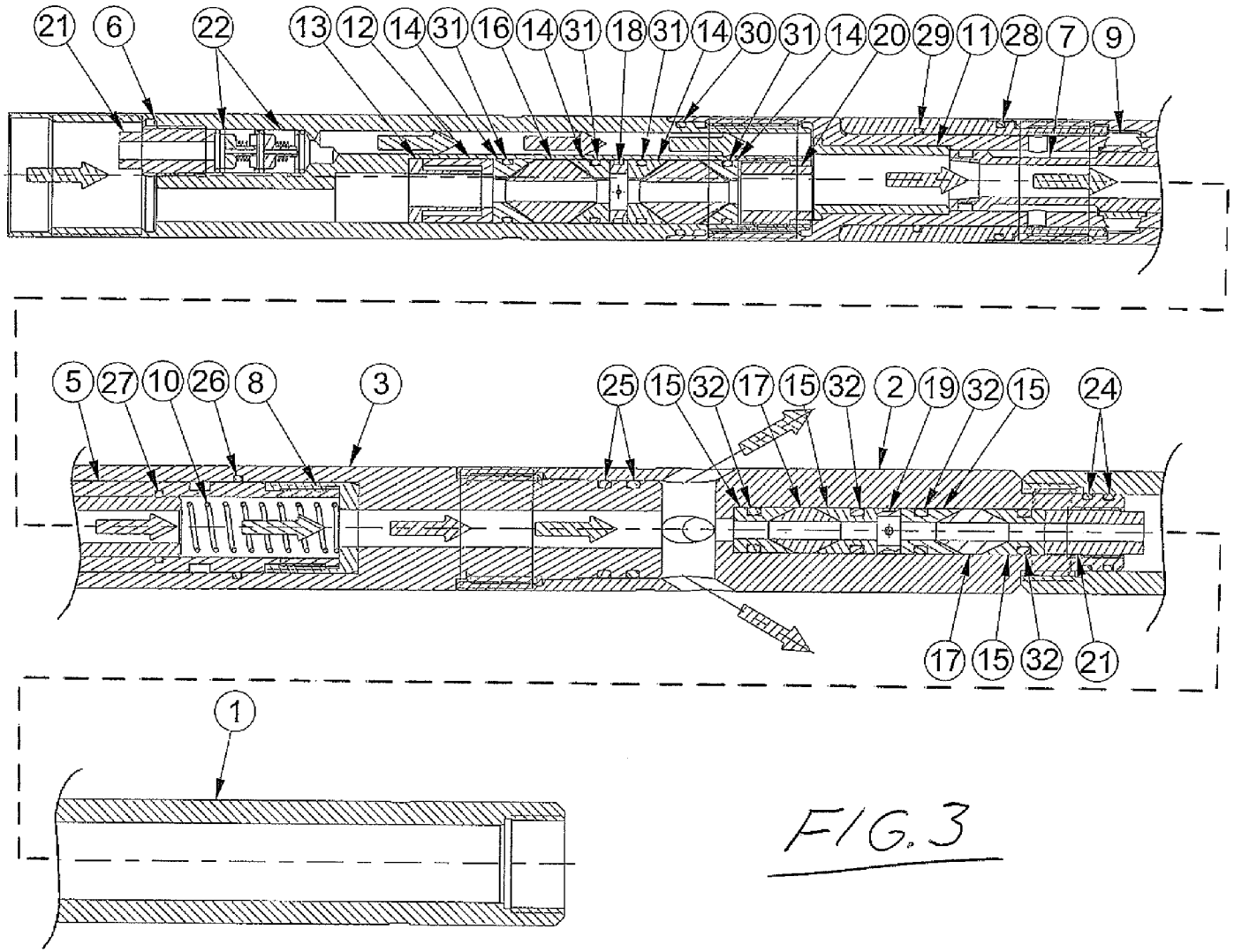
FIG. 3 shows another longitudinal cross section of the cable head in a plane perpendicular to the cross-sectional plane of FIG. 2.
Figure 4A:
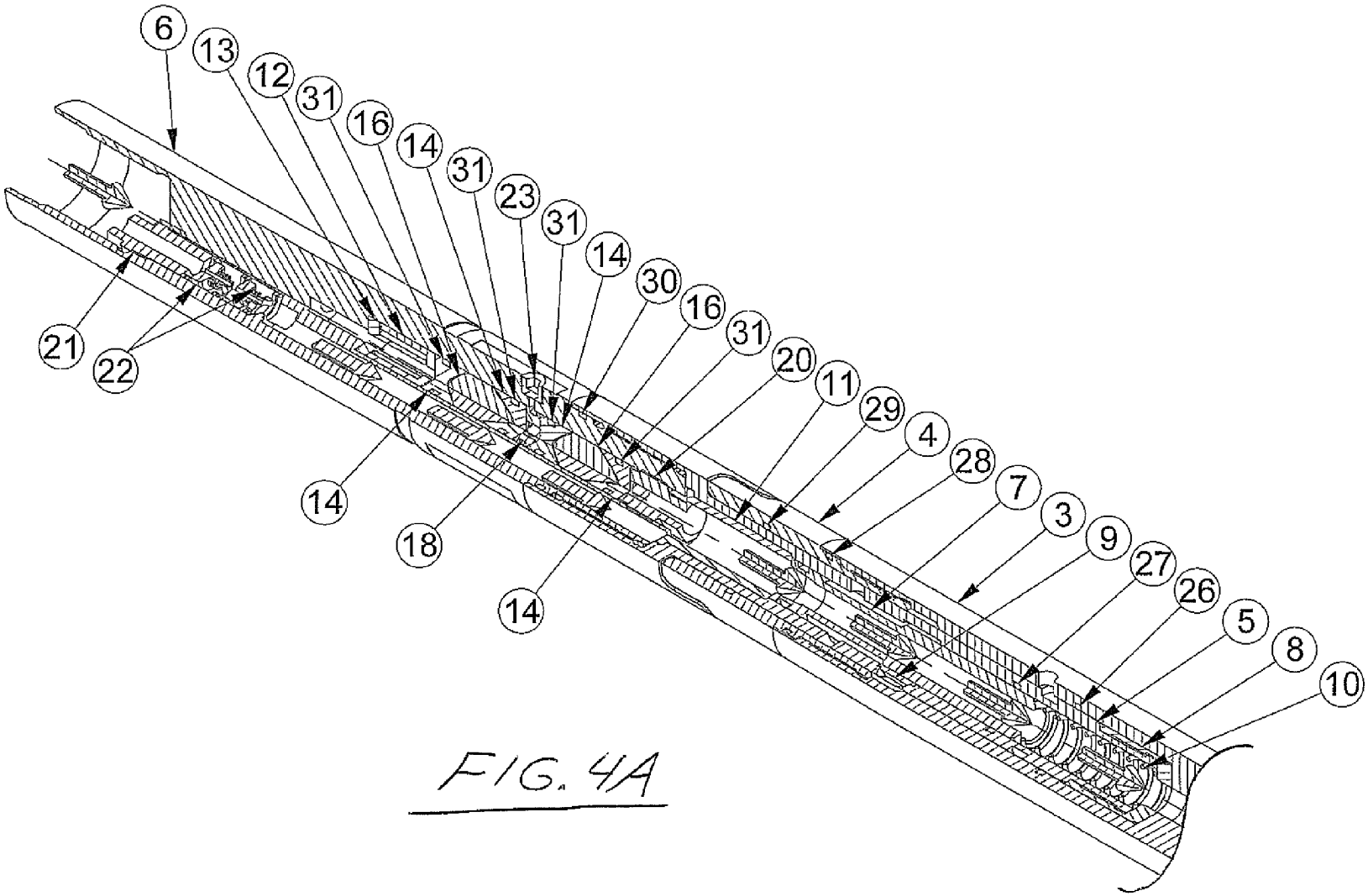
FIGS. 4A and 4B show an isometric section view of the cable head of FIGS. 1 to 3.
Figure 4B:
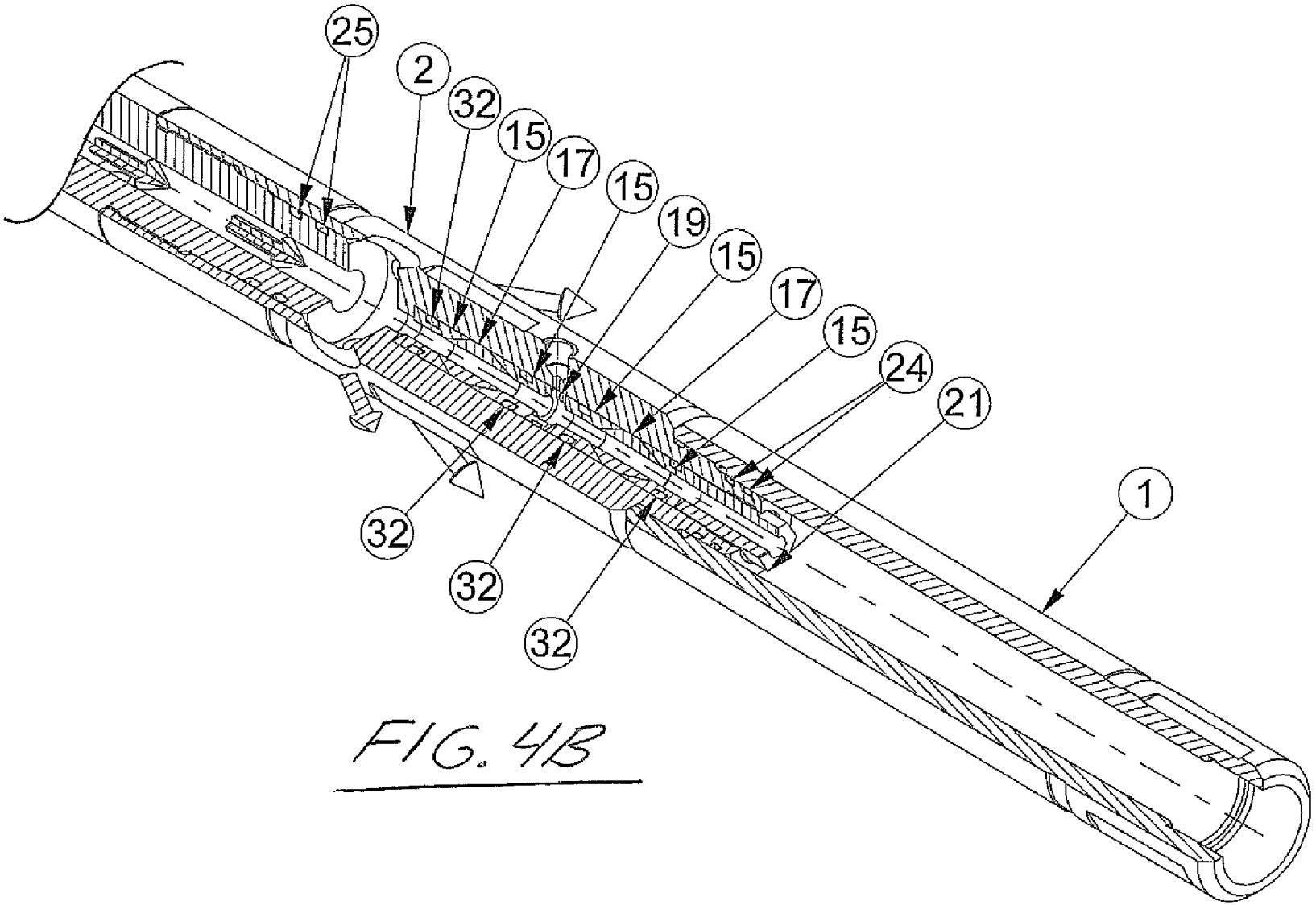

Referring to FIG. 3, the upper housing features an upper pack-off sub 6 forming an upper end of the upper housing and a key-retaining housing 5 threadingly secured to a bottom end portion of the upper pack-off sub 6 with the interior spaces of these two parts open to one another and sealed together by an o-ring 30. The o-ring 30 annularly closes between the outer surface of the bottom end portion of the upper pack-off sub 30 and the inner surface of a cylindrical top end portion of the key-retaining housing 5 at a position above where the respective internal and external threads of the pack-off sub 6 and key-retaining housing 5 engage. The upper housing is completed by a key retainer cap 8 threaded onto a bottom end of the key-retaining housing 5.

A top end of the bottom housing is defined by an upper hydraulic housing 4 (see FIG. 2), which in turn has a two-stage flow release sub 3 threadingly coupled to a bottom end thereof. A bottom portion of key-retaining housing 5 is smaller in outer diameter than an upper portion thereof, which is threaded onto the external threading of the upper-pack off sub 6, and is nested inside the top end of the bottom housing, passing fully through the upper hydraulic housing 4, past the lower end thereof and further into the flow release sub 3. One o-ring 29 seals the outer wall surface of the key-retaining housing 5 to the internal wall surface of the upper hydraulic housing 4, another o-ring 28 seals the outer wall surface of the hydraulic housing 4 to the internal wall surface of the flow release sub 3, and a further o-ring 26 seals the outer wall surface of the key-retaining housing 5 to the internal wall surface of the flow release sub 3.

A lower pack off sub 2 is threaded onto the flow release sub 3 on a lower portion thereof past the capped bottom end of the upper housing's key-retaining housing 5, with additional o-rings 25 sealing between the outer wall surface of the flow release sub 3 and the inner wall surface of the lower pack-off sub 2 between the threaded connection of these components and flow ports passing through the wall the lower pack-off sub 2. These flow ports are marked in the drawings by arrows pointing obliquely outward from the housing, the series of arrows in the drawings being used to illustration a path and direction of fluid flow when pumped downward through the housing as described herein further below. The lower housing is completed by a tear drop cross-over sub 1 threaded onto a bottom end of the lower pack-off sub 2 and sealed thereto by o-ring seals 24 disposed between an inner wall surface of the cross-over sub's top end portion and an outer wall surface of a smaller outer-diameter bottom end portion of the lower pack-off sub 2 below the threaded connection With reference to FIG. 3, the upper pack-off sub 6 features two axial passages therein, each open at a top end thereof positioned a short distance inward from a fully open top end of the sub 6, which is adapted to couple to the free end of a length of coiled tubing in a conventional manner.

One of these passages forms an upper fluid passage through which fluid pumped downhole through the coiled tubing can pass through the upper pack-off sub 6. This upper fluid passage features at two check valves 22, which may be of a kind known in the art such as ball-type or flapper-type check valves to allow fluid flow downwardly through upper fluid passage while preventing upward fluid flow therethrough. Two such check valves are used for redundancy in the event of failure of one of them. A tensioning nut 21 is threadingly engaged into the top end of the upper fluid passage to hold the check valves 22 in place against a valve seat defined by a restriction of the fluid passage further therealong without closing off the top end of the fluid passage.

The other passage in the upper pack-off sub 6 forms an upper cable passage for receiving a length of the electric wireline cable that extends beyond the free end of the coiled tubing with the external armor of the cable intact around the insulated internal conductor. Moving downward along the upper cable passage, it contains a hollow anchor pin 13, an anchor body 12, two packing assemblies each featuring a Teflon packing element 16 sandwiched between two packing cups 14, and a retaining nut 20 threaded into the bottom end of the upper cable passage. A grease ring 18 is additionally disposed between the two packing assemblies. The armor-equipped length of cable extending out from the end of the coiled tubing passes through the upper cable passage, the anchor pin being engaged on the armor and abutting against a stop defined by a step-like reduction in the passage diameter moving toward the open upper end thereof to prevent withdrawal of the cable from the cable passage of the upper housing. The cable has inner and outer armor layers that are wrapped in opposite directions of each other. The outer armor is peeled back and, depending on the number of strands selected for use in anchoring the cable (for example, based on the depth to which the cable needs to depend into the well), the remaining of the outer armor are removed to leave the selected number of strands, which are then bent back over the outside of the hollow anchor pin through which the cable has been passed. At this point, the anchor body is placed over the pin to retain the cable at this location by clamping these bent-back strands of outer armor between the inner surface of the hollow anchor body and the outer surface of the hollow anchor pin. The purpose of this is to anchor the cable in place within the cable head, but also to create a weak point so that if the cable has to be removed from the pipe, in the case where the pipe is stuck in the well, it has a weak point to allow it be removed easier. Other ways of establishing a connection of the cable to the cable head may be employed in place of these described anchor pin configuration, for example using the cable clamp 76 of U.S. Pat. No. 6,196,325.

The cable also passes through the openings of the annular packing elements 16 that form a tight seal around the cable armor between the cable and the surrounding inner wall surface of the cable passage after having been compressed between the packing cups by tightening of the tensioning nut 20. To further improve fluid tight sealing around the cable, grease is injected into the cable passage at a position between the packing assemblies by way of a grease port 23, which is shown in FIG. 3 as being subsequently closed off by a hex socket plug or other suitable closure. The grease ring 18 positioned at this port directs the grease pumped into the passage around the cable to evenly fill the space therearound between the packing assemblies. Each packing cup 14 is also sealed to the cable passage wall by a respective o-ring 31. The sealing arrangement around the cable prevents fluid-flow through the cable passage, thereby cooperating with the check valves 22 of the upper fluid passage to limit any fluid flow in the upper pack-off sub 2 to only downward fluid flow through the upper fluid flow passage.

Each upper passage in the upper pack-off sub 2 is open at the bottom end thereof to an internal bore of the key-retaining housing 5, in which the piston 7 is slidably disposed for displacement along a longitudinal axis of the cylindrical bore. At the bottom of the key-retaining housing 5, the cap 8 presents an inwardly directed flange projecting radially inward past the cylindrical inner wall surface of the key-retaining housing to present an upward facing annular seat against which the bottom end of a compression spring 10 is disposed, while leaving a central opening at the bottom of the key-retaining housing to enable fluid-flow therethrough. The annular bottom end of the hollow piston 7 seats against the top end of the spring 10 so that the piston 7 is biased upward by the spring 10.

An insert 11 nested in the upper end of the piston-containing smaller outer-diameter lower portion of the key-retaining housing 5 presents an outwardly directed flange projecting radially outward from the otherwise cylindrical insert 11 at the top end thereof to seat against a step-wise change in inner diameter of the key-retaining housing 5 just above the change in outer diameter thereof. The tightened threaded engagement of the upper pack-off sub 6 to the key-retaining housing 5 clamps the insert's flange against this seat, and the unflanged bottom end of the insert 11 against a lower seat defined further down by a smaller single-step reduction of the keyway housing's bore further therealong, to maintain the insert's position. An o-ring 27 disposed in a recess in the otherwise cylindrical inner surface of the key-retaining housing 5 between the capped bottom end and the inner-diameter step nearest thereto provides a fluid-tight seal between the outer surface of the piston and the key-retaining housing 5. The figures show the piston in a running position into which it is biased upwardly against the lower end of the insert 11 by the spring 10 so as to take on this position by default, for example as it would during running of the cablehead into a wellbore.

An axial bore through the flow-release sub 3 is coaxial with the axial bore through the key-retaining housing 5 and the axial bore through the hollow piston 7 disposed therein, and features a single-step reduction in diameter to define an upward facing seat or shoulder against which the cap 8 on the bottom of the key-retaining housing rests when the upper and lower housings are connected. The smaller diameter portion of the stepped internal bore of the flow-release sub is of equal diameter to the opening in the cap 8 and cooperates with this opening, the coaxial internal through-bores of the key-retaining housing 5, piston 7 and insert 11; and the upper fluid passage, which is non-concentric but open to these bores, to define a fluid flow path from the open top end of the upper housing (as defined by the upper pack-off sub 6) to the flow ports in the lower pack-off sub 2 of the lower housing immediately beneath the bottom end of the flow-release sub 3. Accordingly, as illustrated by arrows in the drawings, when a fluid is pumped down through coiled tubing and into the cable head housing through the top end thereof, the fluid then passes through this flow path and exits the cable head housing through the flow ports into the annular space between the cable head exterior and the wellbore.

Figure 1:
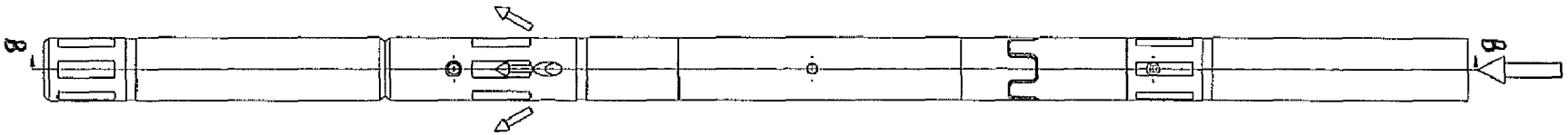
FIG. 1 is an elevational view of a cable head of the present invention for use on coiled tubing having electric line therein for connection to electronic downhole tools or equipment carried on the deployed tubing.
Figure 2:
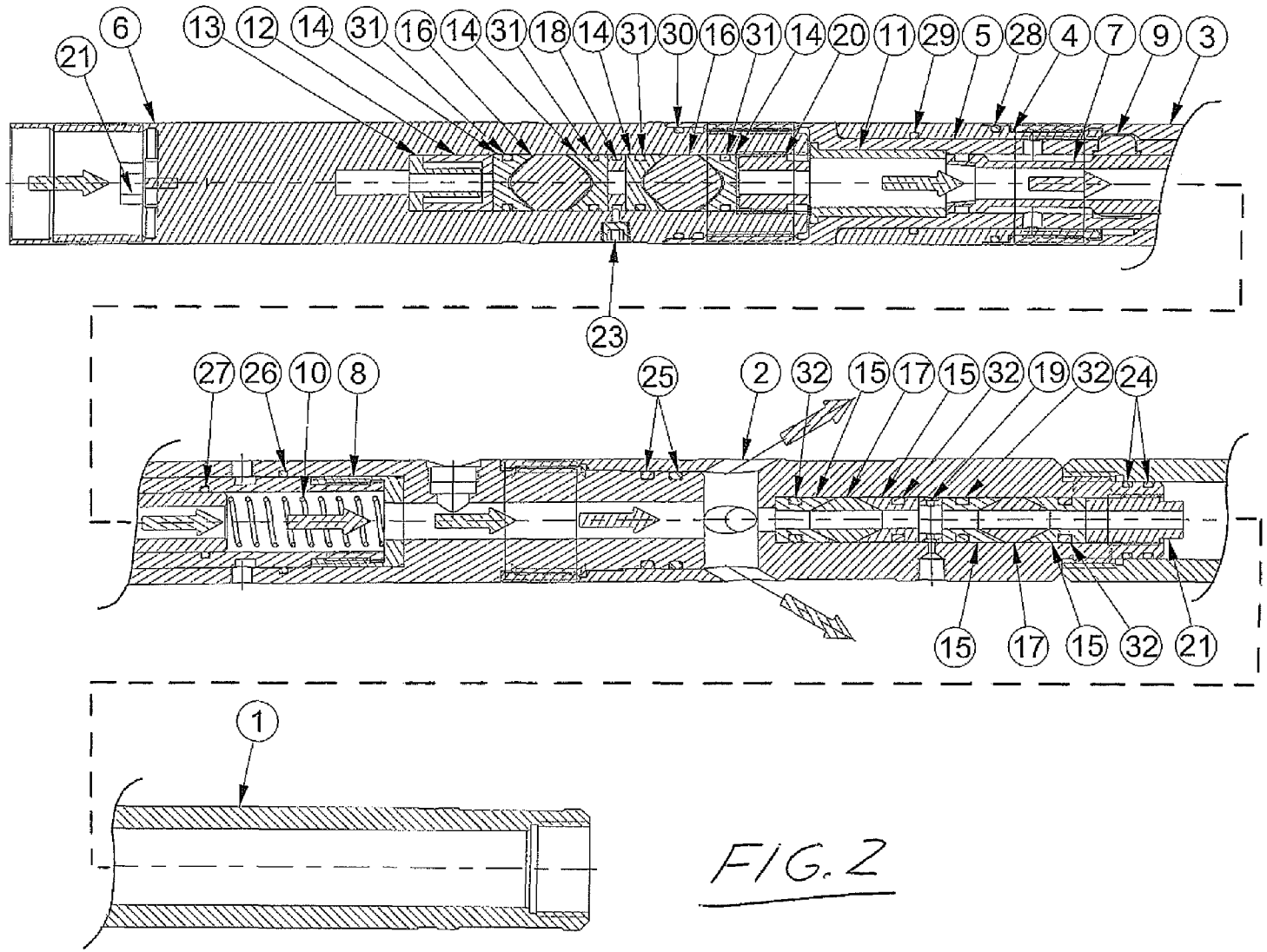
FIG. 2 shows a longitudinal cross section of the cable head of FIG. 1 as taken along line B-B thereof.

With reference to FIG. 2, at the smallest inner-diameter portion of the key-retaining housing 5 between the insert 11 and the capped bottom end, a series of two or more lug windows or key openings are spaced circumferentially around the key-retaining housing 5 and each open radially therethrough at a position intermediately between the insert and a point where the top end of the compression spring would reside when fully compressed. An annular key or lug recess is provided in the internal wall surface of the flow release sub at a position aligning with the windows along the common central longitudinal axis of the tools housing components so that each window faces radially outward into the recess. A chamfer is defined at the upper end of the annular recess by a downward taper in the wall thickness of the hydraulic housing 4 at the bottom end thereof.

A lug or key 9 is disposed in each of the lug windows. Each lug or key 9 has a locked position in which an inner surface of the lug engages a cylindrical outer surface of a bottom portion of the piston below an exterior chamfered annular recess extending around the piston when the piston is in the running position shown in the drawings. The piston's chamfered annular recess has chamfers at the upper and lower ends thereof and has a dimension along the housing's longitudinal axis that exceeds the length of each lug along that axis. Above its chamfered recess, the piston, returns to a same outer diameter as below the chamfered recess, and has this same outer diameter at the piston's upper end. Each lug also has an outer surface which extends into the recess in the flow release sub when the lugs are in the locked position. Further, each lug has an outwardly and upwardly facing chamfer thereon which generally faces chamfer in the top of the lug recess. As will be further described, lugs provide a locking mechanism for preventing relative longitudinal movement of upper and lower housings, thereby preventing premature separation thereof.

Immediately below the flow ports, the inner diameter of the lower pack-off sub 2 dramatically reduces in a single step, and then a short distance further downward undergoes a small single-step increase. The resulting bore, which extends downward from the location of the flow ports and is in concentric alignment with the bore of the flow release sub 3 on the cable head's central longitudinal axis, defines a lower cable passage in which the remaining portion of the electric wireline cable is received after passing through the upper cable passage and onward through portion of the flow path defined by the bores of the insert 11, the piston 7, the key-retaining housing 5 and cap 8, and the flow release housing 3, and the ported upper portion of the lower pack-off sub 2.

The lower cable passage contains a number of the same elements as the upper cable passage, but lacks a cable anchoring or clamping assembly. Accordingly, the lower passage includes, from top to bottom, a first packing assembly, a grease ring 19, a second packing assembly, and a tensioning nut 21. Each packing assembly features a Teflon packing element 17 sandwiched between two packing cups 15, each of which is sealed to the surrounding wall of the bore by a respective o-ring 32. The top packing assembly is disposed against the downward facing seat or shoulder defined by the second step-down of the lower pack-off sub's inner diameter below the flow ports. The grease ring 19 and the cooperation of the tensioning nut with the packing assemblies are used to fluidly seal around the cable armor just like in the upper cable passage.

Figure 5A:
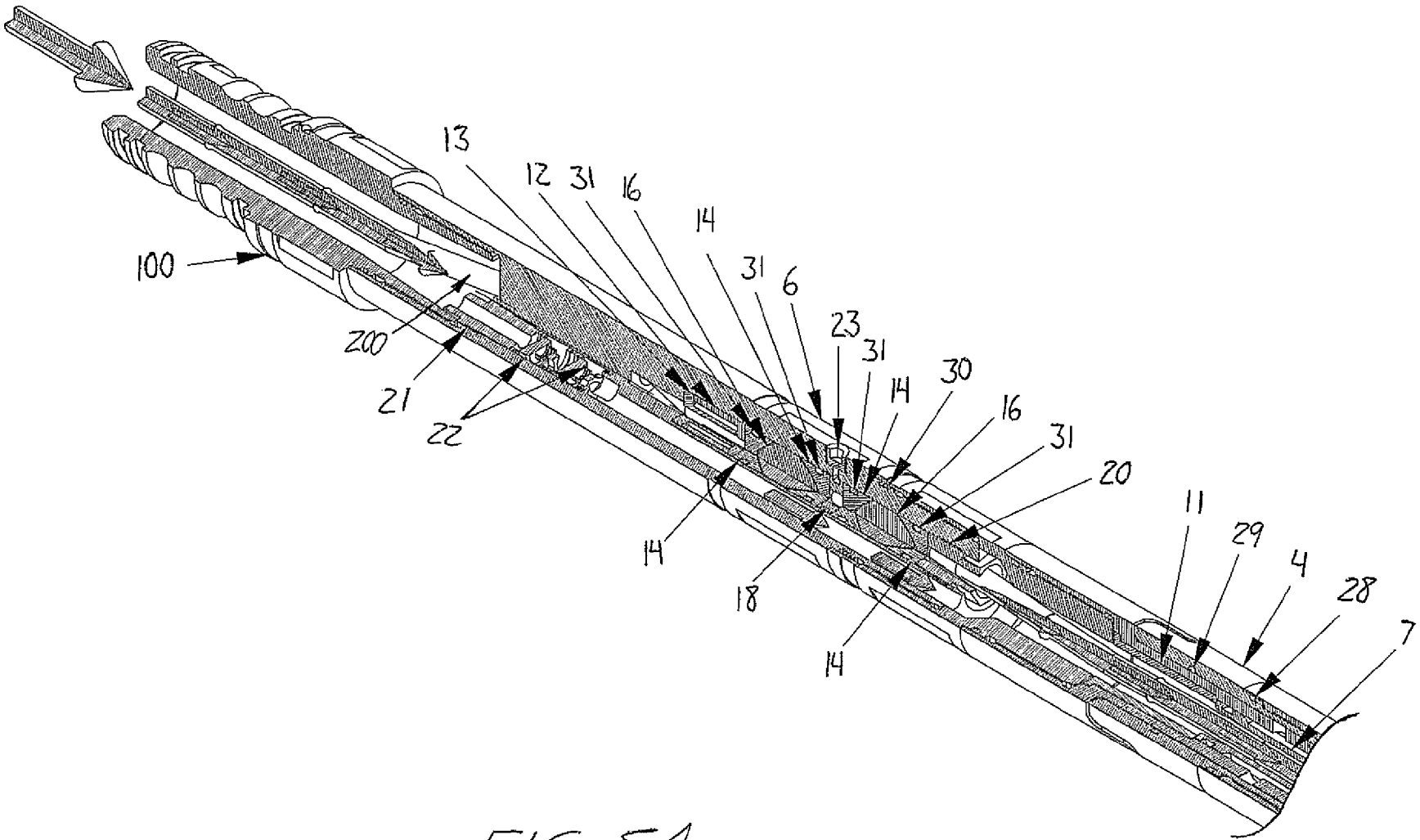
FIGS. 5A and 5B show an isometric section view of a cable head similar to that of FIGS. 1 to 4 with a cross over sub fitted on an upper end thereof, a wireline cable passing through the cable head, and a contact sub assembly fitted on the bottom end of the cable head.

With reference to FIG. 5, the electric wireline cable has at least one layer of armor intact over the full length of its exposure to fluid, continuously along the coiled tubing, into the cable head housing through a roll-on cross-over sub 100 connecting the cable head to the tubing, and onward through the cable head housing until past the flow ports where any fluid pumped through the coiled tubing will exit the cable head housing. Accordingly, the internal conductor of the electric wireline cable is only exposed where it exits the sealed off lower cable passage well beyond the exit point of the pumped fluid. From here, the insulated conductor carries on downward through the tear drop connector sub to a teardrop sub 300 where the actual electrical connection of the cable to the electronic tool or equipment carried below the cable head is achieved in a known manner using this standard equipment. The tear drop cross over sub may be reverse threaded at the top end to allow the sub to be tightened without twisting up the conductor, and may be filled with silicone grease or other suitable material to further seal and protect the electrical connection on the tear drop sub below it.

Figure 5B:
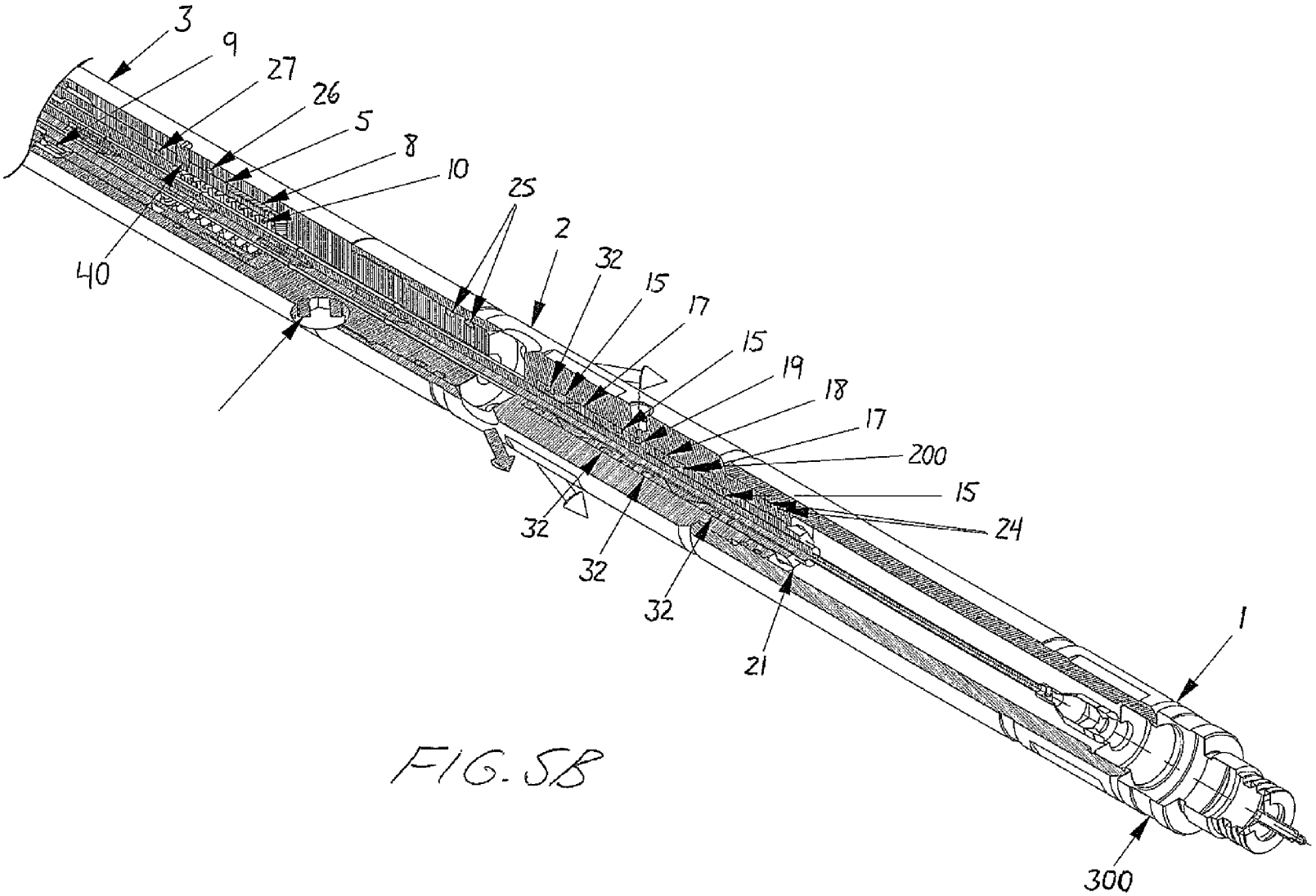

FIG. 5B shows one of a plurality of threaded shear pins 40 engaged in a threaded hole through the wall of the flow release sub 3 of the lower housing so as to project radially inward from the inner surface of the wall into a circumferential groove in the outer surface of the key retaining housing of the upper housing to establish a connection between the upper and lower housings that prevents relative axial sliding therebetween unless the pins have been sheared. Once such shearing takes place however, the upper housing is separable from the lower housing by axial withdrawal of the key retaining housing 5 and cap 8 through the upper end of the lower housing.

In use, the cable head is attached at the upper end of the upper pack-off sub 6 to a roll-on coiled tubing connector sub 300 so that the cable head is at the end of a string of coiled tubing. Piston 7 is in the running position and lugs are in their locked position. A teardrop sub and an attached electric wireline tool are attached to threads at the bottom of the tear drop cross over or connector sub. The tool may be one of any number of known tools, such as a logging tool and/or a set of perforating guns, or a downhole camera. The entire tool string is run into a well in a manner known in the art. If wireline tool includes a logging tool, the logging operation may be carried out in a known manner. If wireline tool includes perforating guns, the guns may be positioned and triggered to carry out the desired perforating operation. In perforating, shock loading may be transmitted upwardly into cablehead as discussed in the aforementioned prior art patent, in that all such shock loading will be absorbed by the locked interconnection of upper housing and lower housing by lugs. That is, no shock loading can be transmitted to shear pins when lugs are in the locked position shown. Therefore, premature shearing of shear pins and separation of upper housing from upper housing are prevented.

If the wireline tool does not become stuck in the well, the coiled tubing, cable head and wireline tool may be retrieved from the well in a normal manner. However, if the wireline tool becomes stuck in the hole, then the cable head may be operated to release the wireline tool from the coiled tubing so that the coiled tubing and the upper housing may be retrieved from the well. The lower housing and the wireline tool are then left in the well and subsequently fished on a separate trip.

Prior to actuation of cablehead, the components therein are in the illustrated positions as already mentioned. The piston is at its uppermost, running position within the housing. The lugs are in the locked position in which relative longitudinal movement between the upper housing and the lower housing is prevented not solely by the shear pins, but also by this stronger engagement of the lugs, and thus shearing of the shear pins is also prevented.

When it is desired to release the wireline tool, fluid is pumped down the coiled tubing which causes flow through the described flow path and out into an annulus (not shown) defined between the tool and the wellbore. Until flow reaches a predetermined level, the piston is held in the running position shown by the compression spring.

As the flow rate of fluid pumped down the coiled tubing is increased, the force acting downwardly on piston, as a result of downward exertion of the pumped fluid against an annular portion of the pistons top face that lies inward from the inner surface of the insert 11 defining the flow path boundary wall immediately above the piston, increases to a an amount causing the piston to stroke downwardly until the recessed lug saddle of the piston is brought into alignment with the lugs so that they are free to be moved radially inwardly to an unlocked position as will be further described herein. Thus, this position of the piston may be referred to as a releasing position. The top end of the hollow piston may be internally threaded to allow coupling of an orifice insert to the piston to reduce the diameter of the internal passage therethrough, thereby increasing the effective surface of the piston's top end to increase the downward force exerted on the piston by fluid pumped downhole through the cable head. Accordingly, by selective addition of an orifice insert, or swapping differently sized orifice inserts for on another in the piston, one can control the flow rate necessarily to activate the piston to initiate the process of separating the cable head housings.

In the releasing position of the piston, tension may be applied to the coiled tubing. Because the wireline tool is stuck, the tension on the coiled tubing will result in the substantially simultaneous shearing of the shear pins and the engagement of chamfers on lugs with the chamfer at the top of the lug recess. This chamfered engagement will force the lugs to be moved radially inwardly to their unlocked position in which inner surfaces thereof are directed toward the lug saddle.

During the application of tension to the coiled tubing, the lugs are moved from their locked position to their unlocked position wherein the inner surfaces of the lugs engage lug saddle of the piston so that the lugs are completely retracted within the lug windows and no longer prevent relative longitudinal axial movement between upper housing and lower housing. Once the upper housing and the lower housing are thus separated, the coiled tubing and the upper housing, along with the components within the upper housing, may be removed from the well. The wireline tool with the lower housing attached thereto remains in the wellbore.

Unlike the aforementioned prior art patent, the single fluid passageway of the cable head of the present invention remains open at all times during use of the tool, and the sliding of the piston in no way interferes with the single set of open flow ports in the housing. Accordingly, an operator is free to pump or circulate fluid down the coiled tubing at any selected fluid rate, as pumping at rates beyond that needed to displace the piston will not cut off the flow through the cable head. Furthermore, due to the use of a lower cable passage configured to seal tightly around the armor of the cable, at no time during use of the cable head is the internal conductor of the cable exposed to any fluid being pumped through the flow path.

As shown in FIGS. 2 and 5B, a burst disk port 42 may be provided in the housing to communicate the interior and exterior of the cable head at a position below the piston so that a burst disc or plug can be fitted within the port to maintain the port in a closed condition unless a pressure within the cable head builds to a level exceeding the burst strength of the disc or plug. This way, if the tool becomes stuck and the normal flow ports are blocked for some reason, thereby preventing the fluid flow through the cable head to displace the piston, the fluid can be pumped into the cable head to build up the pressure beyond the burst strength of the plug in order to open a new fluid passage to the exterior of the cable head through the burst disc port in order to resume the flow through the tool and thus enable downward displacement of the piston to release the lugs and allow separation of the housings.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A cable head for use with coiled tubing electric line in well operations, said cable head comprising:

a housing comprising:

an upper housing adapted for connection to a length of coiled tubing;

a lower housing adjacent to said upper housing; and a shearable connection for shearably attaching said lower housing to said upper housing, said shearable connection being shearable in response to relative movement between said upper housing and said lower housing such that said upper housing and said lower housing are separated when tension is applied to the coiled tubing;

a locking mechanism disposed between said upper and lower housings for preventing said relative movement and thereby preventing shearing of said shearable connection when said locking mechanism is in a locked condition and allowing shearing of said shearable connection by said relative movement when said locking mechanism is in an unlocked condition;

a piston slidably disposed in said housing, said piston having a running position holding said locking mechanism in said locked position and being movable to a releasing position allowing movement of said locking mechanism to said unlocked position;

flow ports defined in the housing and communicating a flow path therein with an exterior of the housing to enable circulation of fluid through the flow path, said flow ports being situated on the housing at positions unobstructed by sliding movement of the piston from the running position to the releasing position, whereby said flow ports remain open throughout said sliding movement of the piston; and a cable passage defined in the upper and lower housings to receive the coiled tubing electric line, said cable passage extending from proximate a top end of the upper housing to a position below the flow path and the flow ports.

2. The cable head of claim 1 wherein the cable passage comprises a lower cable passage that communicates with the flow path and extends to a position below the flow path and the flow ports, the lower cable passage containing at least one lower sealing arrangement adapted to form a fluid tight seal around armor of the coiled tubing electric line.

3. The cable head of claim 2 wherein the lower cable passage opens to the flow path at a bottom end thereof.

4. The cable head of claim 3 wherein the flow ports are positioned at the bottom end of the flow path.

5. The cable head of claim 1 wherein the cable passage comprises an upper cable passage that is open to the top end of the upper housing to receive the coil tubing electric line, said upper cable passage containing a cable anchor to secure the coiled tubing electric line to the upper housing and an upper sealing arrangement adapted to form a fluid tight seal around armor of the coiled tubing electric line.

6. The cable head of claim 1 wherein the flow path comprises an internal passage extending through the piston, said internal passage also defining a portion of the cable passage.

7. The cable head of claim 1 in combination with the coiled tubing electric line, said coiled tubing electric line having external armor containing an internal conductor and said armor of said coiled tubing electric line extending down to the position past the flow path and the flow ports, where the internal conductor of the coiled tubing electric line exits the armor for connection to electronic downhole equipment.

8. The cable head of claim 1 wherein the flow ports are positioned below the piston.

9. The cable head of claim 1 wherein the flow path, between opposite ends thereof, communicates with the exterior of the housing only through the flow ports regardless of the piston's position.

10. The cable head of claim 1 wherein said lower housing defines a recess therein, said upper housing defines a lug window therein aligned with said recess; and said locking mechanism comprises a lug disposed in said window and extending into said recess when in said locked position and spaced from said recess when in said unlocked position.

11. The cable head of claim 10 wherein said piston has a recessed saddle thereon and said lug extends into said saddle when in said unlocked position.

12. A cable head for use in well operations with coiled tubing electric line having external armor containing an internal conductor, said cable head comprising:

a housing comprising:

an upper housing adapted for connection to a length of coiled tubing;

a lower housing adjacent to said upper housing; and a shearable connection for shearably attaching said lower housing to said upper housing, said shearable connection being shearable in response to relative movement between said upper housing and said lower housing such that said upper housing and said lower housing are separated when tension is applied to the coiled tubing;

a locking mechanism disposed between said upper and lower housings for preventing said relative movement and thereby preventing shearing of said shearable connection when said locking mechanism is in a locked condition and allowing shearing of said shearable connection by said relative movement when said locking mechanism is in an unlocked condition;

a piston slidably disposed in said housing, said piston having a running position holding said locking mechanism in said locked position and being movable to a releasing position allowing movement of said locking mechanism to said unlocked position;

flow ports defined in the housing and communicating a flow path therein with an exterior of the housing to enable circulation of fluid through the flow path; and a cable passage defined in the upper and lower housings to receive the coiled tubing electric line, said cable passage extending from proximate a top end of the upper housing and comprising a lower cable passage that communicates with the flow path and extends to a position below the flow path and the flow ports, the lower cable passage containing at least one lower sealing arrangement that is situated below the flow path and the flow ports and is adapted to form a fluid tight seal around the armor of the coiled tubing electric line.

13. The cable head of claim 12 wherein the cable passage comprises an upper cable passage that is open to the top end of the upper housing to receive the coil tubing electric line, said upper cable passage containing a cable anchor to secure the coiled tubing electric line to the upper housing and an upper sealing arrangement adapted to form a fluid tight seal around armor of the coiled tubing electric line.

14. The cable head of claim 12 wherein the lower cable passage opens to the flow path at a bottom end thereof.

15. The cable head of claim 12 wherein the flow ports are positioned at the bottom end of the flow path.

16. The cable head of claim 12 wherein the flow path comprises an internal passage extending through the piston, said internal passage also defining a portion of the cable passage.

17. The cable head of claim 12 in combination with the coiled tubing electric line, the armor of said coiled tubing electric line extending down to the position past the flow path and the flow ports, where the internal conductor of the coiled tubing electric line exits the armor for connection to electronic downhole equipment.

* * * * *